US005722386A

United States Patent [19]

Fladgard et al.

[11] Patent Number: 5,722,386

[45] Date of Patent: Mar. 3, 1998

[54] METHOD AND APPARATUS FOR FORMING ORNAMENTAL EDGES ON CEMENT SIDING

[75] Inventors: Scott Fladgard; Lloyd Fladgard, both of Kingston, Wash.

[73] Assignee: Pacific International Tool & Shear, Ltd., Kingston, Wash.

[21] Appl. No.: 701,770

[22] Filed: Aug. 26, 1996

Related U.S. Application Data

[63] Continuation-in-part of Ser. No. 351,599, Dec. 7, 1994, Pat. No. 5,570,678.

[51] Int. Cl.[6] ..... B28D 1/32

[52] U.S. Cl. ..... 125/23.01; 125/40; 83/237; 83/679

[58] Field of Search ..... 125/22, 23.01, 125/40; 83/679, 237, 696, 694

[56] References Cited

U.S. PATENT DOCUMENTS

| | | | |
|---|---|---|---|
| 2,411,016 | 11/1946 | Azzara | 83/696 |
| 3,263,539 | 8/1966 | Daniel et al. | 83/237 |
| 3,524,374 | 8/1970 | Diolot | 83/630 |
| 3,728,997 | 4/1973 | Fletcher et al. | 125/23.01 |
| 3,771,401 | 11/1973 | Jasinski | 83/679 |
| 3,958,480 | 5/1976 | Rohde et al. | 83/237 |
| 4,057,087 | 11/1977 | Oldenburg | 83/679 |
| 4,694,717 | 9/1987 | Boots | 83/237 |

*Primary Examiner*—Eileen Morgan
*Attorney, Agent, or Firm*—Seed and Berry LLP

[57] ABSTRACT

A method and apparatus for producing a non-linear, ornamental edge along a cement siding workpiece. In accordance with one embodiment of the invention, a first cutting blade is configured to have a non-linear shape corresponding to a shape of an ornamental feature that is to be cut in the cement siding workpiece. A second cutting blade is then configured to have the non-linear shape of the first cutting blade. The first and second cutting blades are aligned with one another to position a first cutting edge on the first cutting blade opposite to a second cutting edge on the second cutting blade. A cement siding workpiece is then positioned between the first and second cutting blades so that the first and second cutting blades are aligned with a location at which an ornamental feature is desirably formed on the workpiece. The first and second cutting edges are subsequently driven into the cement siding workpiece until the first and second cutting blades shear through the workpiece and form a non-linear, ornamental edge along the workpiece in the shape of the first and second cutting blades.

28 Claims, 6 Drawing Sheets

METHOD AND APPARATUS FOR FORMING ORNAMENTAL EDGES ON CEMENT SIDING

CROSS-REFERENCE TO PRIOR APPLICATION

This application is a continuation-in-part of U.S. Pat. No. 5,570,678, filed Dec. 7, 1994 Ser. No. 08/351,599 and entitled "CEMENT SIDING SHEARING TOOL".

TECHNICAL FIELD

The present invention relates to a method and an apparatus for cutting ornamental, non-linear edges on cement siding planks, shakes, and panels used in the construction of buildings.

BACKGROUND OF THE INVENTION

The exterior of houses and other types of buildings are commonly covered with siding materials that protect the internal structure from external environmental elements. Siding may be made from a variety of materials, including wood, concrete, brick, aluminum, stucco, wood composites, and cement/cellulose composites. Wood siding is popular, but it is costly, flammable, subject to infestation, subject to cracking, and comes from a diminishing resource. Aluminum is also popular, but it is easily deformed, subject to expanding/contracting, and relatively expensive. Brick and stucco siding are popular in certain regions of the country, but they are costly and labor-intensive to install.

Cement siding offers several advantages compared to other types of siding. Cement siding is made from a mixture of cement, silica sand, cellulose, and a binder. The cement siding mixture is pressed and then cured to form planks, panels and boards of finished cement siding. Cement siding is advantageous because it is non-flammable, weather-proof, not subject to rotting or infestation, and relatively inexpensive to manufacture. Cement siding is also advantageous because it may be formed with simulated wood grains or other designs that give the appearance of a natural product. Thus, cement siding is becoming an increasingly popular siding material in many areas of the country.

In addition to protecting the internal structure of a building, siding must also provide an aesthetically pleasing appearance because the siding is a dominant external feature on small buildings. Many new houses and small office buildings, in fact, use ornamental wood shakes or wood planks with non-linear edges to obtain "Victorian," "gingerbread," or other types of architectural designs. The ornamental, non-linear edges on wood siding have many shapes such as semi-circles, triangles, semi-hexagons, and other polygonal shapes. The wood siding is typically cut with a band saw along one of the longitudinal edges of a plank to form a long non-linear edge, or across its width to form an ornamental wood shake. Ornamental wood siding is generally installed at selected locations on a structure, such as the top of gables, around turrets, or other decorative areas.

Although cement siding offers many advantages over other siding materials, it is not widely used to make ornamental design features on houses or buildings because it is difficult and expensive to cut along a non-linear line. Ornamental cement siding pieces are conventionally formed by cutting the siding with a bandsaw or a jigsaw that can travel through cement siding along a non-linear cutting path. Cutting cement siding using a saw, however, generates large amounts of fine dust that makes the working environment unpleasant. Additionally, cement siding is relatively hard and requires a significant amount of time to cut with conventional saws. Therefore, in light of the positive characteristics of cement siding, it would be desirable to develop an apparatus and method that quickly cuts clean, non-linear edges on a cement siding workpiece without producing noticeable quantities of dust.

SUMMARY OF THE INVENTION

The present invention is a method and apparatus for producing a non-linear, ornamental edge along a cement siding workpiece. In accordance with one embodiment of the invention, a first cutting blade is configured to have a non-linear shape corresponding to a shape of an ornamental feature that is to be cut in the cement siding workpiece. A second cutting blade is then configured to have the non-linear shape of the first cutting blade. The first and second cutting blades are aligned with one another to position a first cutting edge on the first cutting blade opposite to a second cutting edge on the second cutting blade. A cement siding workpiece is then positioned between the first and second cutting blades so that the first and second cutting blades are aligned with a location at which an ornamental feature is desirably formed on the workpiece. The first and second cutting edges are subsequently driven into the cement siding workpiece until the first and second cutting blades shear through the workpiece and form a non-linear, ornamental edge along the workpiece in the shape of the first and second cutting blades.

DETAILED DESCRIPTION OF THE INVENTION

The present invention is a method and apparatus that quickly cuts non-linear, ornamental edges on cement siding workpieces without producing noticeable quantities of dust or other particulate matter. An important aspect of an embodiment of the invention is to configure a set of shearing blades into a non-linear shape that corresponds to a desired ornamental shape to be cut in the cement siding workpiece. Another important aspect of an embodiment of the invention is to align a first shearing blade with a second shearing blade, and then drive the first and second shearing blades into the cement siding workpiece until the blades shear through the workpiece. By configuring the shearing blades into a shape corresponding to the ornamental features, and preferably with several ornamental features repeated in a single blade set, a number of ornamental features may be cut in a short period of time and without producing significant quantities of cement dust. FIGS. 1–7E, in which like reference numbers refer to like parts throughout the various views, illustrate several cement siding cutters and methods in accordance with the invention.

Figure 1:
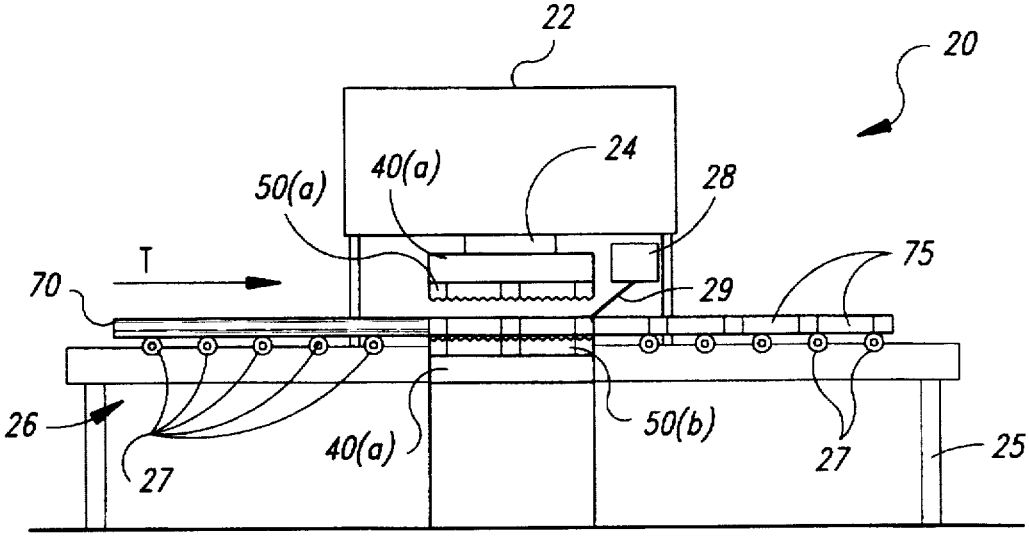
FIG. 1 is a schematic side view of a cement siding cutter used in a method in accordance invention.
Figure 2:
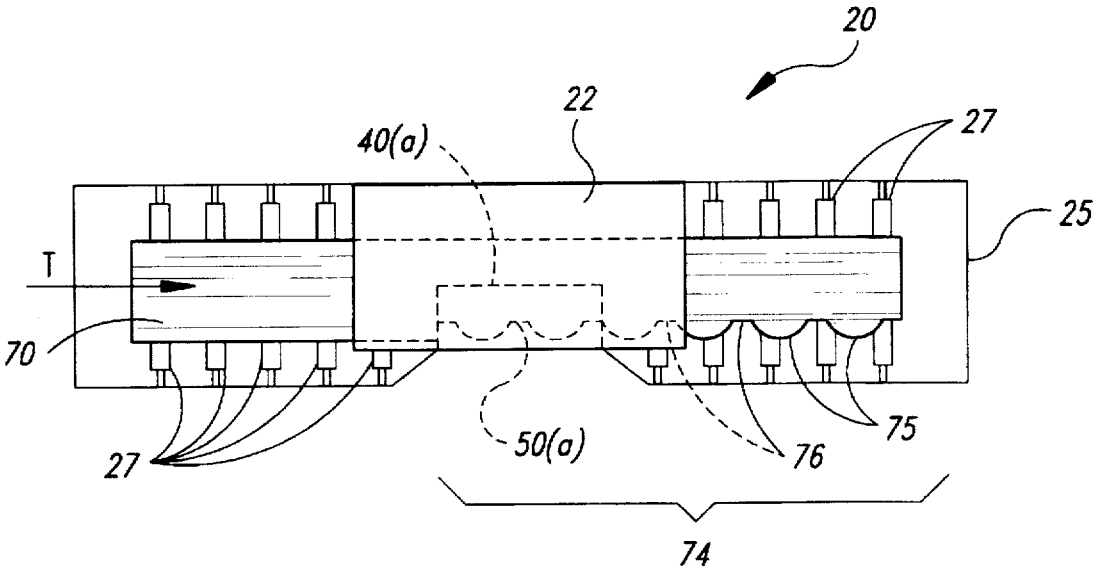
FIG. 2 is a schematic plan view of the cement siding cutter of FIG. 1.

FIGS. 1 and 2 illustrate an embodiment of a cement siding cutter 20 in accordance with the invention for cutting a non-linear, ornamental edge along a longitudinal edge of a cement siding plank. The cement siding cutter 20 has a press 22 that drives a ram 24 between a raised position and a lowered position. The press 22 and ram 24 are positioned above a conveyor track 26 that has a number of rollers 27 on either side of the ram 24. A first blade holder 40(*a*) is attached to the ram 24, and a second blade holder 40(*b*) is positioned under the first blade holder 40(*a*). The second blade holder 40(*b*), conveyor track 26, and press 22 are preferably mounted to a frame 25.

The blade holders 40(*a*) and 40(*b*) hold cutting blades 50(*a*) and 50(*b*), respectively, so that the first cutting blade 50(*a*) is aligned with the second cutting blade 50(*b*). To cut a cement siding workpiece 70, the ram 24 drives the first cutting blade 50(*a*) downwardly towards the second cutting blade 50(*b*). As discussed in detail below, the first and second cutting blades 50(*a*) and 50(*b*) penetrate into the cement siding workpiece causing a crack to propagate through the workpiece between the cutting blades in a plane defined by the alignment of the cutting blades.

Figure 3:
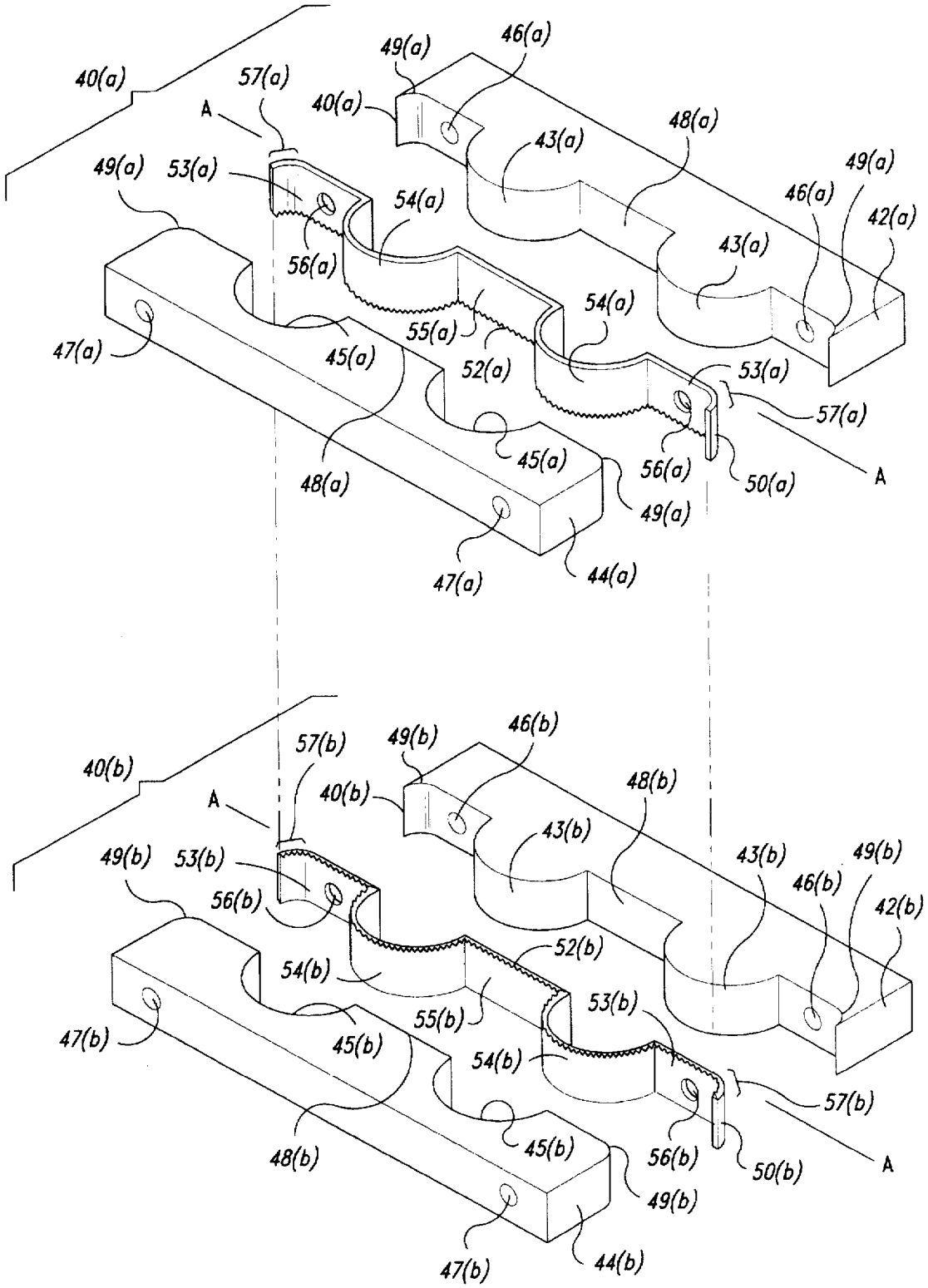
FIG. 3 is an exploded isometric view of blade holders and cutting blades in accordance with the invention.

FIG. 3 illustrates one embodiment of the blade holders 40(*a*) and 40(*b*), and the non-linear cutting blades 50(*a*) and 50(*b*), for cutting a plurality of spaced apart, semi-circular (scalloped) ornamental features along an edge of a cement siding workpiece. For the purposes of brevity, only the first blade holder 40(*a*) and the first cutting blade 50(*a*) will be discussed with the understanding that the second blade holder 40(*b*) and the second cutting blade 50(*b*) are substantially similar. The first blade holder 40(*a*) has a male frame segment 42(*a*) with projections 43(*a*) and a straight section 48(*a*). The first blade holder 40(*a*) also has a female frame segment 44(*a*) with recesses 45(*a*) and a straight section 48(*a*). The ends of the male and female frame segments 42(*a*) and 44(*a*) are preferable flared with curved sections 49(*a*) to direct the ends of the cutting blade 50(*a*) away from the straight sections 48(*a*). The juxtaposed surfaces on the male and female frame segments 42(*a*) and 44(*a*) are sized and shaped to substantially mate with one another and form a non-linear slot between the male and female frame segments 42(*a*) and 44(*a*). To assemble the blade holder 40(*a*) and first cutting blade 50(*a*), bolts (not shown) positioned through holes 47(*a*) of the female frame member 42(*a*) and holes 56(*a*) of the cutting blade 50(*a*) threadedly engage threaded holes 46(*a*) in the male frame member 42(*a*). The bolts draw the male and female frame members 42(*a*) and 44(*a*) together to clamp the cutting blade 50(*a*) in a desired position.

The first cutting blade 50(*a*) has a serrated cutting edge 52(*a*), and it is configured into a non-linear shape corresponding to the non-linear slot defined by the frame segments 42(*a*) and 44(*a*). In one embodiment the cutting blade 50(*a*) may be configured from end segments 53(*a*), contoured segments 54(*a*), and a straight center segment 55(*a*). The end segments 53(*a*) are preferably flared at their tips 57(*a*) so that the tips 57(*a*) follow the curved sections 49(*a*) and project away from a back line A—A of the cutting blade 50(*a*). The tips 57(*a*) of the end segments 53(*a*) project away from the back line A—A to direct cracks that propagate from the tips of the cutting blade 50(*a*) into portions of the cement siding workpiece that will be removed in subsequent cuts. The contoured segments 54(*a*) of the first blade 50(*a*) are sized and shaped to match the contour of the projections 43(*a*) and the recesses 45(*a*) of the blade holder 40(*a*). Similarly, the straight center segment 55(*a*) is sized and shaped to mate with the straight section 48(*a*) of the first blade holder 40(*a*). The end segments 53(*a*), contour segments 54(*a*), and the straight segment 55(*a*) of the cutting blade 50(*a*) may be separate pieces that are individually attached to the blade holder 40(*a*). As shown in the embodiment of FIG. 3, the cutting blade 50(*a*) may also be configured from a contiguous piece of material that is shaped into the desired non-linear, ornamental shape.

The shapes of the first and second cutting blades 50(*a*) and 50(*b*) are not limited to the spaced apart scallops shown in FIG. 3, but rather may be configured to form any non-linear ornamental shape. Additionally, the lengths of the cutting blades 50(*a*) and 50(*b*) are not limited to forming a specific number of ornamental features. For example, the cutting blades 50(*a*) and 50(*b*) may extend along substantially the full longitudinal length of a plank or across the full width of a panel, and the cutting blades may have the desired number of features appropriately spaced apart from one another to cut the planks and panels in a single stroke of the ram 24 of the cement siding cutting device 20 (shown in FIGS. 1 and 2). In a preferred embodiment, the cutting blades 50(*a*) and 50(*b*) have a length sufficient to cut an incremental portion of the longitudinal length of a plank because it is generally easier to control shorter cuts than longer cuts.

Figure 4A:
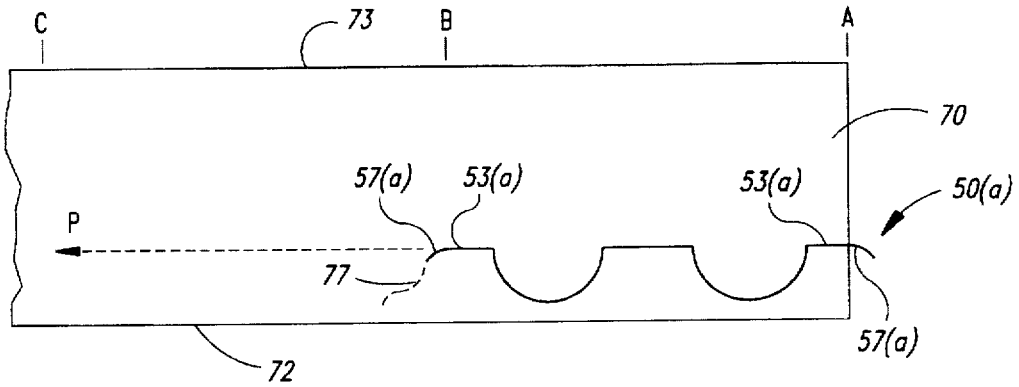
FIG. 4A is a schematic partial plan view of a cement siding plank at one point in a method of the invention.
Figure 4B:
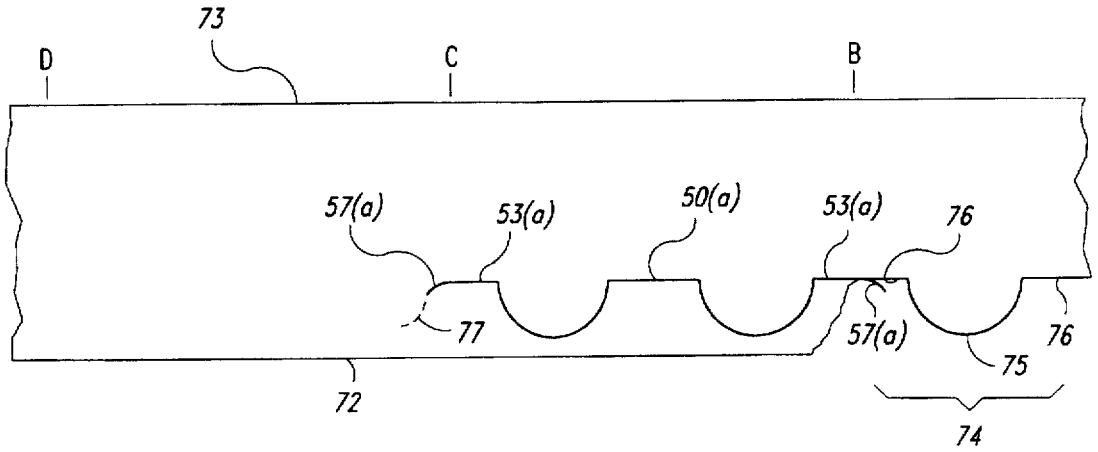
FIG. 4B is a schematic plan view of the cement siding plank of FIG. 4A at another point in a method of the invention.

FIGS. 4A and 4B illustrate an embodiment of a method in accordance with the invention for cutting a plurality of non-linear, ornamental features along a longitudinal edge 72 of a cement siding plank 70. Referring to FIG. 4A, the first blade 50(*a*) presses against a cement siding plank 70 and drives towards the second cutting blade 50(*b*), which is under the plank 70 in substantial alignment with the first cutting blade 50(*a*) (see FIG. 1). It will be appreciated that the second cutting 50(*b*) is positioned directly below the first cutting blade 50(*a*), and thus the second cutting blade 50(*b*) and all parts of the second cutting blade 50(*b*) are not visible in FIGS. 4A and 4B. The first cutting blade 50(*a*) preferably presses against the cement siding plank 70 with a substantially even pressure between the first and second cutting blades 50(*a*) 50(*b*) along the full length of the cutting blades 50(*a*) and 50(*b*). The first and second cutting blades 50(*a*) and 50(*b*) penetrate the cement siding plank 70 and shear an increment of the cement siding plank 70 between points A and B.

In a preferred embodiment, the cutting blades 50(*a*) and 50(*b*) engage the cement siding plank 70 near the longitudinal edge 72, and the tips 57(*a*) and 57(*b*) of the cutting blades are directed towards the longitudinal edge 72. The cutting blades 50(*a*) and 50(*b*) desirably engage the cement siding plank 70 near the longitudinal edge 72 to reduce fractures in the finished portion of the cement siding between the cutting blades and the other longitudinal edge 73 of the cement siding plank 70. Additionally, the tips 57(*a*) and 57(*b*) of the cutting blades are directed outwardly towards the longitudinal edge 72 so that fracture lines 77 will generally propagate through the waste portion of the cement siding between the cutting blades and the longitudinal edge 72 of the cement siding plank 70. By appropriately aligning the cutting blades 50(*a*) and 50(*b*) with one another and pressing the first cutting blade 50(*a*) with an even force along its full length, the cutting blades 50(*a*) and 50(*b*) form a non-linear, ornamental cut that corresponds to the shape of the cutting blades along an A–B section of the cement siding plank 70. After cutting the siding plank 70 along the A–B section, the cutting blades 50(*a*) and 50(*b*) disengage the cement siding plank 70 and the plank is indexed to position a B–C section of the cement siding plank 70 between the cutting blades 50(*a*) and 50(*b*). The plank 70 may be indexed by hand or by a device (not shown) that moves the plank 70 with respect to the cutting blades 50(*a*) and 50(*b*). As shown in FIG. 1, the plank 70 may be indexed by an actuator 28 that moves an arm 29 in the direction T as the arm 29 grips the plank 70.

FIG. 4B illustrates the cement siding plank 70 shown in FIG. A after the plank 70 has been indexed to position the B–C section of the cement siding plank 70 between the cutting blades 50(*a*) and 50(*b*). The A–B section of the cement siding plank 70 accordingly has a non-linear, ornamental edge 74 with a number of shaped features 75 and a number of flat segments 76. To continue the non-linear, ornamental edge 74 along the B–C section of the cement siding plank 70, the cement siding workplank 70 is positioned between the cutting blades 50(*a*) and 50(*b*) so that the right end segments 53(*a*) and 53(*b*) of the cutting blades overlap the left flat segment 76 of the non-linear edge 74 cut on the A–B section of the plank 70. In general, one cut overlaps another by approximately 0.1–0.6 inches. To form a second incremental cut along the B–C section of the plank 70, the cutting blades 50(*a*) and 50(*b*) engage the cement siding plank 70 of the plank and shear through the plank as discussed above with respect to FIG. 4A. The incremental cutting process is continued along the full length of the cement siding plank 70 to form a non-linear, ornamental edge 74 along the full length of the plank 70.

Figure 5A:
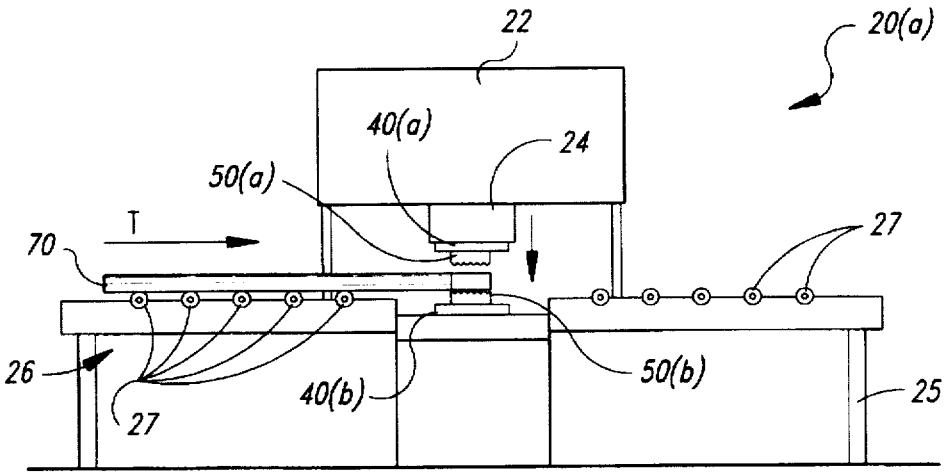
FIG. 5A is a schematic side view of another cement siding cutter used in accordance with another method of the invention.
Figure 5B:
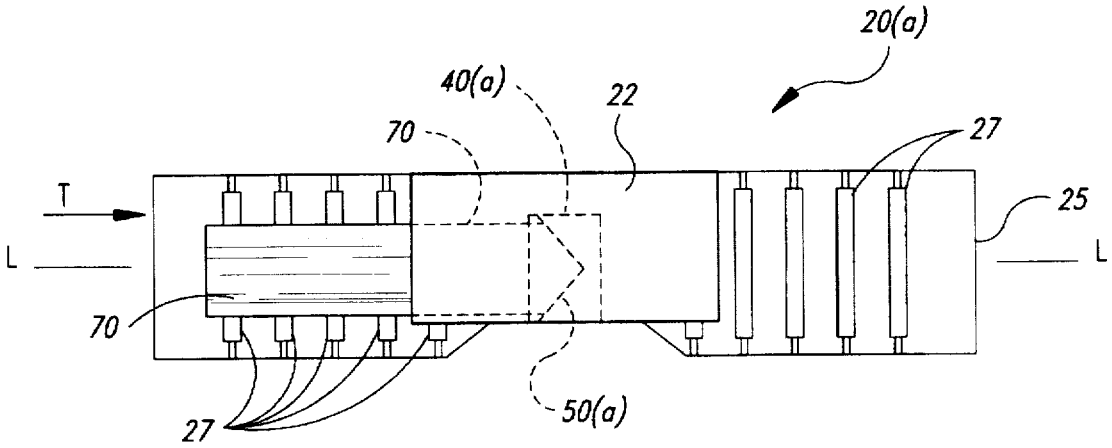
FIG. 5B is a schematic plan view of the cement siding cutter of FIG. 5A.

FIGS. 5A and 5B illustrate another cement siding cutter 20(*a*) in accordance with the invention for cross-cutting a non-linear, ornamental edge across a cement siding plank 70 or a cement siding panel (not shown). As discussed above with respect to the cement siding cutter 20 shown in FIGS. 1 and 2, the cement siding cutter 20(*a*) has a press 22 and ram 24 positioned above a conveyor track 26 that has a number of rollers 27. The cement siding cutter 20(*a*), however, has first and second blade holders 40(*a*) and 40(*b*) that hold cutting blades 50(*a*) and 50(*b*) transversely with respect to the longitudinal axis L—L of the cement siding plank 70. The blade holders 40(*a*) and 40(*b*), and the cutting blades 50(*a*) and 50(*b*), are substantially the same as those described above with respect to FIGS. 1 and 2. One difference, however, is that the tips of the cutting blades 50(*a*) and 50(*b*) of the cross-cut configuration do not need to be flared at the ends when the cutting blades 50(*a*) and 50(*b*) extend across the full width of the cement siding plank. Unlike the incremental longitudinal cut shown in FIGS. 4A and 4B, the end of the cut does not coincide with the end of the cutting blade. Thus, when the cutting blades 50(*a*) and 50(*b*) extend across the full width of the workpiece, the ends of the curing blades will not generate unwanted cracks in the siding.

In operation, the cement siding plank 70 is translated in a direction T between the cutting blades 50(*a*) and 50(*b*) to a desired position, and then the first cutting blade 50(*a*) is pressed against the cement siding workpiece 70 to cut the workpiece along a line defined by the cutting blades 50(*a*) and 50(*b*). It will be appreciated that the non-linear, ornamental cross-cut is formed in substantially the same manner as discussed above with respect to the longitudinal cut shown in FIGS. 4A and 4B.

Figure 6A:
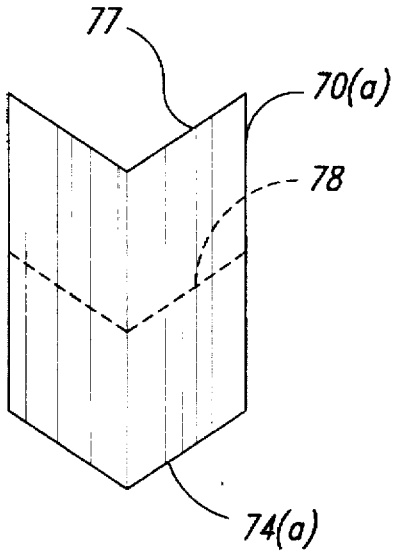
FIG. 6A is a partial plan view of an ornamental cement siding shake cross-cut in accordance with a method of the invention.
Figure 6B:
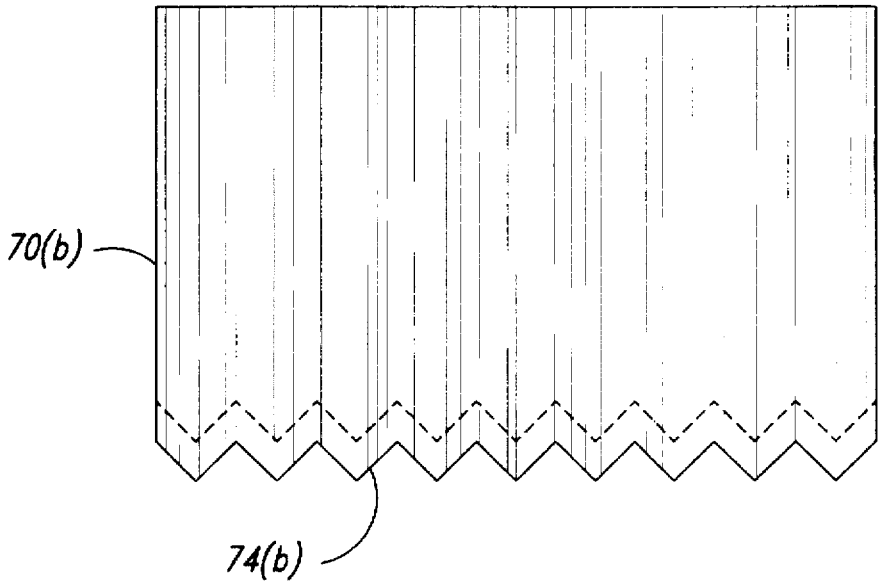
FIG. 6B is a partial plan view of an ornamental edge of a cement siding panel cross-cut in accordance with a method of the invention.

FIGS. 6A and 6B illustrate finished ornamental cross-cuts in cement siding workpieces. Referring to FIG. 6A, an ornamental shake 70(*a*) has an ornamental cross-cut edge 74(*a*) formed using the cement siding cutter 20(*a*) shown in FIGS. 5A and 5B. The ornamental shake 70(*a*) also has a tail end 77 that is formed by the next cross-cut of the next shake. In operation, another shake (not shown) covers the tail end 77 so that it overlaps the shake 70(*a*) to an intermediate line 78. Referring to FIG. 6B, a non-linear, ornamental edge 74(*b*) may be cross-cut along the width of a cement panel 70(*b*). The non-linear, ornamental edge 74(*b*) may be cut with a single cross-cut blade adapted to form a plurality of ornamental features in a similar or identical manner to the blade holders and blades shown in FIGS. 1 and 2. The cement siding panels 70(*b*) may be subsequently cut at a different point (shown in phantom) to form a series of panel sections that may be assembled to overlap one another and give the appearance of ornamental shakes.

Figure 7A:
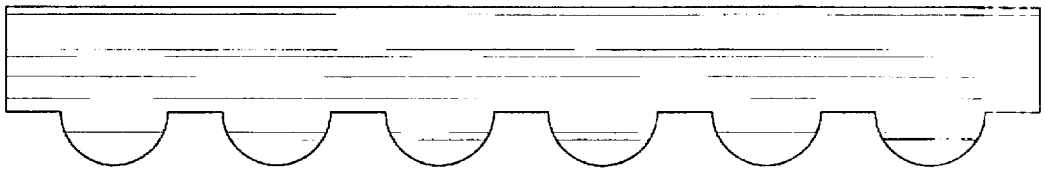
FIG. 7A is a plan view of a cement siding plank cut in accordance with a method of the invention.
Figure 7B:
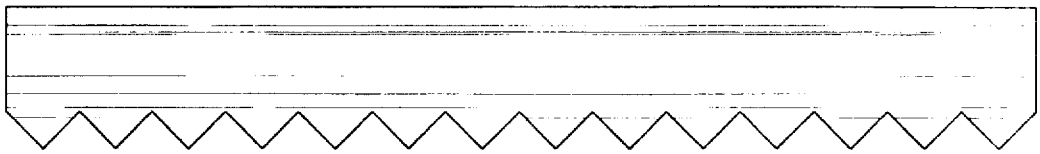
FIG. 7B is a plan view of another cement siding plank cut in accordance with a method of the invention.
Figure 7C:
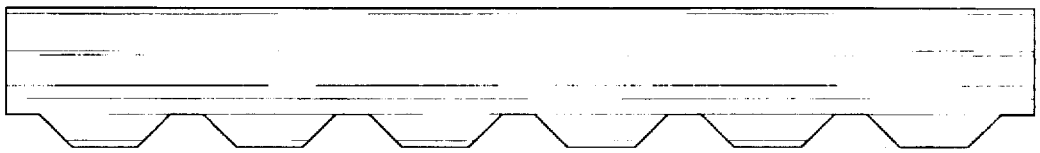
FIG. 7C is a plan view of another cement siding plank cut in accordance with a method of the invention.
Figure 7D:
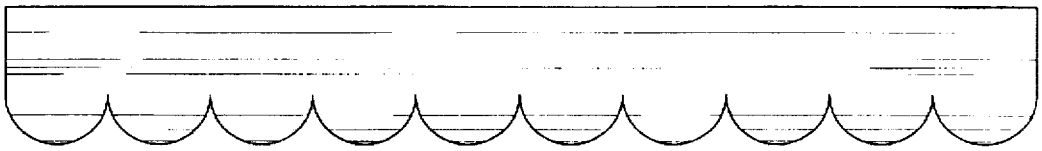
FIG. 7D is a plan view of another cement siding plank cut in accordance with the invention.
Figure 7E:
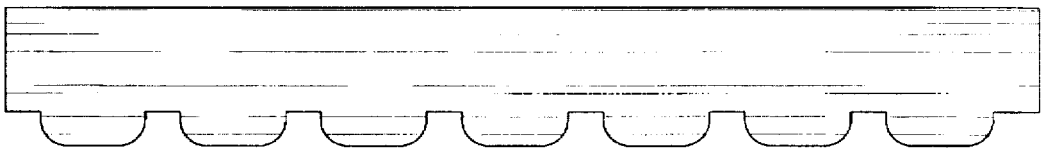
FIG. 7E is a plan view of another cement siding plank cut in accordance with a method of the invention.

FIGS. 7A–7E illustrate various ornamental shapes in which the blade holders 40(*a*) and 40(*b*), and the cutting blades 50(*a*) and 50(*b*), may be configured to cut cement siding. FIG. 7A shows a spaced apart scalloped ornamental shape; FIG. 7B illustrates a sawtooth ornamental shape; FIG. 7C illustrates a semi-hexagonal ornamental shape; FIG. 7D illustrates a continuous semi-circle ornamental shape; and FIG. 7E illustrates a truncated semi-circle ornamental shape. The shapes illustrated in FIGS. 7A–7E are merely examples of the types of ornamental shapes that may be fabricated in accordance with the method of the invention. The invention is not intended to be limited by the ornamental shapes illustrated in FIGS. 7A–7E, as most non-linear ornamental shapes in which the cutting blades may be configured are within the scope of the invention.

One advantage of the method and apparatus of the present invention is that ornamental, non-linear edges are quickly formed on cement siding planks, shakes, and panels. Unlike conventional bandsaws in which the blade must be moved along a non-linear line with exact precision, the present invention quickly cuts ornamental features by merely aligning the cutting blades with the workpiece and engaging the blades with the workpiece. The present invention accordingly forms non-linear, ornamental features in cement siding much faster than conventional sawing cutting methods. Therefore, the present invention reduces the costs of manufacturing ornamental cement siding.

Another advantage of the present invention is that it does not produce a noticeable amount of dust. Unlike conventional bandsaws that saw through the cement siding and produce a tremendous amount of fine cement dust, the present invention shears through the cement siding and only produces a negligible amount of dust. Therefore, compared to bandsawing, the environment around the cement siding cutter of the present invention is much more pleasant and clean.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method for producing a non-linear ornamental edge on a cement siding workpiece, comprising the steps of:

providing a first non-linear cutting blade having a first contiguous cutting edge and a second non-linear cutting blade having a second contiguous cutting edge, the first and second non-linear cutting blades having a non-linear shape corresponding to a shape of an ornamental design feature, and the first and second cutting blades being aligned with one another to position the first cutting edge opposite to the second cutting edge;

positioning the workpiece between the first and second cutting blades so that the first and second cutting blades are aligned with a cut line on the workpiece at which an ornamental feature is desirably formed; and driving the first and second cutting edges against opposing sides of the cement siding workpiece at the cut line so that the first and second cutting edges simultaneously penetrate the cement siding to an intermediate depth along the length of the contiguous first and second cutting edges juxtaposed to the workpiece to form a non-linear cut through the workpiece in the shape of the first and second cutting blades.

2. The method of claim 1 wherein:

the workpiece is a cement siding plank having first and second longitudinal edges defining a plank, and the first and second cutting blades have a blade length at least as long as the plank length;

the positioning step comprises orientating the plank with respect to the first and second cutting blades so that the first and second shearing blades engage the plank near the first longitudinal edge; and the driving step comprises engaging the first and second cutting blades along the length of the plank and forming the non-linear ornamental edge along the length of the first longitudinal edge in a single stroke of the cutting blades.

3. The method of claim 1 wherein:

the workpiece is a cement siding plank having first and second longitudinal edges defining a plank length, and the first and second cutting blades have blade length less than the plank length;

the driving step comprises engaging the first and second cutting blades near the first longitudinal edge along a portion of the plank length to form the non-linear ornamental edge along a first portion of the first longitudinal edge; and the positioning step further comprises indexing the plank with respect to the first and second cutting blades after the driving step so that a second portion of the plank is positioned between the first and second cutting blades.

4. The method of claim 3 wherein the indexing step comprises aligning a leading end of the first and second blades with a trailing end of the first portion of the first longitudinal edge of the plank.

5. The method of claim 4 wherein the method further comprises repeating the engaging, indexing, and aligning steps incrementally along the plank length to form the non-linear edge along the plank length in a plurality of strokes.

6. The method of claim 1 wherein:

the cement siding workpiece is a cement siding plank having first and second longitudinal edges spaced apart from one another by a plank width; and the positioning step comprises orientating the plank with respect to the first and second cutting blades so that the first and second cutting blades engage the plank transversely to the first and second longitudinal edges across the plank width to form a non-linear cross-cut at an end of the cement siding plank.

7. The method of claim 1 wherein:

the cement siding workpiece is a panel having first and second longitudinal edges spaced apart by a panel width; and the positioning step comprises orientating the panel with respect to the first and second cutting blades so that the first and second cutting blades engage the panel transversely to the first and second longitudinal edges across the panel width to from a non-linear cross-cut at an end of the panel.

8. The method of claim 1 wherein the non-linear shape of the cutting blades corresponds to the shape of a plurality of design features, and wherein the driving step comprises cutting a plurality of design features in the workpiece in a single engagement of the cutting blades.

9. The method of claim 1 wherein the non-linear shape of the cutting blades includes a semi-circular section, and wherein the driving step comprises cutting a semi-circle design feature in the workpiece.

10. The method of claim 9 wherein the cutting step comprises positioning a portion of the semi-circle section beyond an edge of the workpiece to cut a truncated semi-circular design feature in the workpiece.

11. The method of claim 1 wherein the non-linear shape of the cutting blades includes a V-shaped section, and wherein the driving step comprises cutting a V-shaped design feature in the workpiece.

12. The method of claim 1 wherein the non-linear shape of the cutting blades includes a semi-hexagonal section, and wherein the driving step comprises cutting a semi-hexagonal design feature in the workpiece.

13. The method of claim 1 wherein the non-linear shape of the cutting blades includes a plurality of semi-circular sections, and wherein the driving step comprises simultaneously cutting a plurality of semi-circular design features in the workpiece.

14. A method for producing a non-linear ornamental edge on a cement siding workpiece, comprising the steps of:

configuring a first cutting blade with a first contiguous cutting edge to have a non-linear shape corresponding to a shape of an ornamental feature;

configuring a second cutting blade with a second contiguous cutting edge to have the non-linear shape of the first cutting blade;

aligning the first cutting blade with the second cutting blade to position the first cutting edge directly opposite to the second cutting edge;

positioning the workpiece between the first and second cutting blades so that the first and second cutting blades are aligned with a cut line of the workpiece at which an ornamental feature is desirably formed; and driving the first and second contiguous cutting edges against opposing sides of the cement siding workpiece at the cut line so that the first and second cutting edges simultaneously penetrate the cement siding to an intermediate depth along the length of the contiguous first and second cutting edges juxtaposed to the workpiece to form a non-linear cut through the workpiece in the shape of the first and second cutting blades.

15. The method of claim 14 wherein:

the workpiece is a cement siding plank having first and second longitudinal edges defining a plank length, and the first and second cutting blades have a blade length at least as long as the plank length;

the configuring step of the first cutting blade comprises forming a non-linear shape corresponding to a shape having plurality of ornamental features;

the configuring step of the second cutting blade comprises forming a non-linear shape corresponding to the shape of the first cutting blade;

the positioning step comprises orientating the plank with respect to the first and second cutting blades so that the first and second cutting blades engage the plank near the first longitudinal edge; and the driving step comprises engaging the first and second cutting blades along the length of the plank to form the non-linear ornamental edge along the plank length in a single engagement of the cutting blades.

16. The method of claim 14 wherein:

the workpiece is a cement siding plank having first and second longitudinal edges defining a plank length, and the first and second cutting blades have a blade length less than the plank length;

the driving step comprises engaging the first and second cutting blades near the first longitudinal edge along a portion of the plank length to form the non-linear ornamental edge along a first portion of the first longitudinal edge; and the positioning step further comprises indexing the plank with respect to the first and second cutting blades after the driving step so that a second portion of the plank is positioned between the first and second cutting blades.

17. The method of claim 16 wherein the first and second blades each have a leading tip and a trailing tip, and wherein the configuring steps of the first and second blades comprises flaring the leading and trailing tips so that the tips project towards the first longitudinal edge when the plank is oriented with respect to the first and second cutting blades.

18. The method of claim 16 wherein the indexing step comprises aligning the leading end of the first and second blades with a trailing end of the first portion of the first longitudinal edge oft he plank.

19. The method of claim 18 wherein the method further comprises repeating the engaging, indexing, and aligning steps incrementally along the plank length to form the non-linear edge along the plank length in a plurality of strokes.

20. The method of claim 14 wherein:

the cement siding workpiece is a cement siding plank second longitudinal second longitudinal edges spaced apart from one another by a plank width; and the positioning step comprises orientating the plank with respect to the first and second cutting blades so that the first and second cutting blades engage the plank transversely to the first and second longitudinal edges across the plank width to form a non-linear cross-cut at an end of the cement siding plank.

21. The method of claim 14 wherein:

the cement siding workpiece is a panel having first and second longitudinal edges spaced apart by a panel width; and the positioning step comprises orientating the panel with respect to the first and second cutting blades so that the first and second cutting blades engage the panel transversely to the first and second longitudinal edges across the panel width to from a non-linear cross-cut at an end of the panel.

22. The method of claim 14 wherein the configuring steps comprise creating a semi-circular section in each cutting blade, and wherein the driving step comprises cutting a semi-circle design feature in the workpiece.

23. The method of claim 22 wherein the aligning step comprises positioning a portion of the semi-circle section beyond an edge of the workpiece to cut a truncated semi-circular design feature in the workpiece.

24. The method of claim 14 wherein the configuring steps comprise creating a V-shaped section in each cutting blade, and wherein the driving step comprises cutting a V-shaped design feature in the workpiece.

25. The method of claim 14 wherein the configuring steps comprise creating a semi-hexagonal section in each cutting blade, and wherein the driving step comprises cutting a semi-hexagonal design feature in the workpiece.

26. The method of claim 14 wherein the configuring steps comprise creating a plurality of semi-circular sections in each cutting blade, and wherein the driving step comprises simultaneously cutting a plurality of semi-circular design features in the workpiece.

27. A cement siding cutting device, comprising:

a press having a ram that moves between a raised position and a lowered position;

a support platform positioned under the press;

an upper blade holder attached to the ram, the upper blade holder having a first flame segment with a first contoured mounting face and a second flame segment with a second contoured mounting face juxtaposed to the first mounting face of the first flame segment, the first and second mounting faces defining a first nonlinear slot having a shape corresponding to a shape of an ornamental design;

a contiguous upper cutting blade having a non-linear shape corresponding to the shape of the ornamental design and a cutting edge, the upper cutting blade being positioned in the first non-linear slot of the upper blade holder;

a lower blade holder having a third frame segment with a third contoured mounting face and a fourth frame segment with a fourth contoured mounting face juxtaposed to the third mounting face of the third frame segment, the third and fourth mounting faces defining a second non-linear slot having a shape corresponding to the shape of the first non-linear slot in the upper segment, the lower blade holder being attached to the support platform below the upper blade holder so that the second non-linear slot of the lower blade holder is aligned with the first non-linear slot of the upper blade holder; and a contiguous lower blade having a non-linear shape corresponding to the shape of the ornamental design and a cutting edge, the lower cutting blade being positioned in the second non-linear slot of the lower blade holder and aligned with the upper cutting blade, wherein the ram drives the upper blade against the cement siding workpiece and the upper and lower blades shear through the workpiece to form an edge having the shape of the ornamental feature.

28. The cement siding cutting device of claim 27 wherein the slots in the upper and lower blade holders have flared ends to direct leading and trailing tip portions of the upper and lower cutting blades towards a waste section of the workpiece.

* * * * *